US006272205B1

(12) United States Patent
Hell et al.

(10) Patent No.: US 6,272,205 B1
(45) Date of Patent: Aug. 7, 2001

(54) X-RAY RADIATOR

(75) Inventors: Erich Hell, Erlangen; Peter Schardt, Roettenbach, both of (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 09/306,251

(22) Filed: May 6, 1999

(30) Foreign Application Priority Data

May 7, 1998 (DE) ..... 198 20 476

(51) Int. Cl.[7] ..... H01J 35/30

(52) U.S. Cl. ..... 378/137; 378/125

(58) Field of Search ..... 378/125, 137

(56) References Cited

U.S. PATENT DOCUMENTS 4,334,153 6/1982 Stehman et al. .
4,993,055 2/1991 Rand et al. .
5,822,395 * 10/1998 Schardt et al. ..... 378/137

FOREIGN PATENT DOCUMENTS 0 138 486 4/1985 (EP) .

* cited by examiner

*Primary Examiner*—Craig E. Church
(74) *Attorney, Agent, or Firm*—Schiff Hardin & Waite

(57) ABSTRACT

An X-ray radiator with a rotating bulb X-ray tube, with an allocated deflecting magnet system having at least one current-supplied coil for generating a magnetic deflecting field, has a circuit for tapping at least one reference signal representative of the high voltage existing at the X-ray tube. The coil current is adjusted by a control unit depending on this reference signal.

13 Claims, 1 Drawing Sheet

X-RAY RADIATOR

BACKGROUND OF THE INVENTION

1. Field of the Invention

The present invention relates to an X-ray radiator, of the type having a rotary X-ray tube with an allocated deflecting magnet system with at least one current-conducting coil for generating a magnetic deflecting field.

2. Description of the Prior Art

In X-rays radiators of the type described in U.S. Pat. No. 4,993,055, the complete X-ray tube rotates in a cooling medium which is enclosed by the radiator housing. For this reason, the emitter usually must emit the electrons on the axis of rotation, these electrons being accelerated by the high voltage between the emitter—which represents the cathode—and the anode. These electrons without further auxiliary means, i.e. if undeflected, would propagate straight ahead to the anode. To deflect the electron beam onto the provided focal spot outside the anode center, there needs to be an additional force on the electrons. This is produced by a magnetic field which is generated by the deflecting magnet system. The magnitude of the magnetic field becomes larger as the speed of the electrons increases, because of the Lorentz force. The deflection current which is carried by the coil and the high voltage of the X-ray tube thus have a functional connection.

Dependent on the different radiological applications, X-ray tubes are operated at different high voltages. As explained, in X-ray radiators with rotating bulb tubes, the deflecting current of the deflection system must be set dependent on the high voltage which is employed. Consequently, the control of the magnet system, i.e. the control of the coil current, must receive as a control signal representative of the level of the high voltage of the tube, so that the corresponding coil current can be set. Conventional X-ray radiators operate in such a way that the deflecting coil current is stored, as a function of the high voltage, in a database of the control computer for the radiator. Thus, by means of electronics and a controllable direct current source for the deflecting current, the deflecting current can be adjusted corresponding to the applied high voltage and can be fed to the X-ray radiator via additional cables. This control design is entirely acceptable for a new X-ray device. Problems arise, however, when an apparatus with a conventionally assembled X-ray tube is to be retrofitted to function as a rotating bulb X-ray radiator. Since these radiators are based on different characteristics, the voltage generator would also have to be retrofitted, so that the two elements are compatible and an adequate control of the radiator is possible. Although it would be possible to transmit, in turn, the high voltage signal at the generator side to the radiator as a separate signal via an additional line, this is disadvantageous to the extent that additional cable has to be laid and corresponding additional terminals have to be provided at the radiator itself.

German OS 31 36 881 and European Application 0 138 486 teach tapping a reference voltage which is proportional to the high voltage pending at an X-ray tube, for obtaining a focusing voltage corresponding to the high voltage, or for controlling an inverter.

SUMMARY OF THE INVENTION

An object of the present invention is to provide an X-ray radiator of the abovementioned type which can be integrated into an existing X-ray device by retrofitting without the assembly of additional lines, and which enables an operation of the X-ray device without a retrofitting of the voltage generator.

The object is achieved in accordance with the invention in an X-ray radiator of the abovementioned type, wherein at least one reference signal is tapped which is dependent on the existing high voltage, and the coil current is adjusted by a control unit dependent on the reference signal.

From the high voltage presently existing at the X-ray tube, the inventive X-ray radiator generates the corresponding control signal for the adjustment of the coil current itself. This means that an X-ray radiator can be retrofitted without complications, since in this regard it functions autarkically with respect to the generator in reference to the coil current control. Based on the reference signal, which is proportional to the existing high voltage, the control unit is able to adjust the coil current corresponding to the high voltage which is currently present.

As long as the tube is operated such that the high voltage is at only the cathode or at the anode, it is enough to tap only one reference signal and to feed it to the control unit. However, since usually one-half of the high voltage is at the anode and one-half is at the cathode, an anode-side reference signal can be tapped and a cathode-side reference signal can be tapped, with the current control being dependent on the sum of the two reference signals. This dual tapping of reference signals assures that possible voltage fluctuations or shifts, which can lead to differences between the respective voltages pending at the cathode and anode sides, are reliably detected, and the high voltage which actually exists can be detected correctly, so that the current control can correctly ensue.

In the case where it is either guaranteed that the voltages at the cathode and anode sides are held extremely constant, equaling U/2, for example, or that they are in a predetermined ratio which is kept constant and varies extremely insignificantly, if at all, tapping of only one anode-side or one cathode-side reference signal can be done, in which case the control unit generates the control signal for the coil current dependent on the known ratio. In the case where the sub-voltages equal U/2, respectively, the control unit merely doubles the reference signal, while in cases of different ratios, the tapped reference signal is correspondingly further processed and weighted. As a result of the voltage constancy, the high voltage can be obtained exactly and the coil current can be controlled exactly in this case. The reference signal or the sum of the two reference signals preferably should be less than 40 V, particularly less than 20 V. A signal of about 10 V has proven appropriate.

To easily generate the coil current to be adjusted with reference to the presently existing high voltage, a control characteristic describing the coil current as a function of the tube voltage can be stored in the control unit, and using this characteristic the control signal for the coil current can be generated on the basis of the reference signal.

A concrete circuit for tapping the reference voltage can include at least one voltage divider, connected between the high voltage and ground and which communicates with the control unit. In the case where the voltage is at the anode and cathode sides, two voltage dividers can be inventively provided, one of which is connected to the high voltage at the anode side, and the other of which is connected to the high voltage at the cathode side, both preferably being connected to a common ground point. For selecting the level (portion) of the existing high voltage which is tapped, the (or each) voltage divider can include a serpentine resistor. With such a voltage divider it is possible to tap a selected fraction of the pending high voltage as the reference signal. The control unit itself can be inventively arranged in the interior of the radiator housing, which is advantageous particularly with respect to the retrofitting, since there are co parts projecting from the radiator housing in this case. Furthermore, cable bushings through the radiator housing are not necessary. An external arrangement is of course also possible, however.

Besides the X-radiator itself, the invention also relates to an X-ray devic having an X-radiator of the inventive type.

DESCRIPTION OF THE PREFERRED EMBODIMENTS

Figure 1:
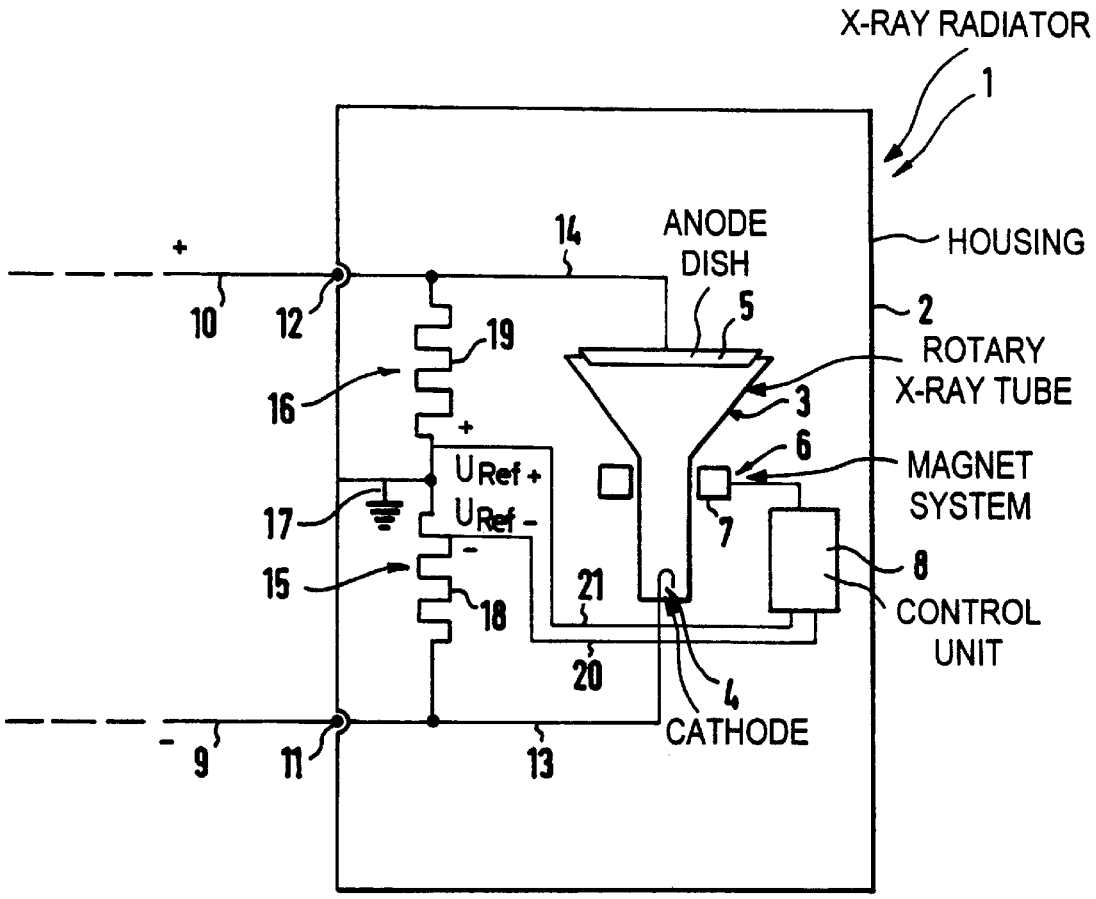
FIG. 1 is a schematic illustration of the basic components of an inventive X-ray radiator.

FIG. 1 shows an inventive X-ray radiator 1 consisting of a radiator housing 2, which is filled with a cooling medium such as a cooling fluid in the radiator housing 2. An X-ray tube 3 is mounted within the radiator housing 2 so that the tube bulb can be rotated. The X-ray tube 3 contains a cathode 4 and an anode dish 5, across which is a high voltage for accelerating electrons that are emitted by the cathode. To deflect these emitted electrons to the periphery of the anode dish 5, a deflecting magnet system 6 is provided, which has a deflecting magnet 7, which is arranged at and surrounds the neck of the X-ray tube 3, as well as a control unit 8 allocated to said magnet. To generate a deflecting magnetic field with which the emitted electrons are deflected from their intrinsically linear flight path, a number of coils are provided at the deflecting magnet 7, usually four, which form a quadrupole. The coils have current-flowing therein, so that a magnetic field develops. The coil current, which is delivered via a direct current source (not depicted), is correspondingly adjusted by means of the control unit 8, the existing high voltage being the basis for the adjustment. The magnetic field, and thus the deflecting current to be applied, are made larger, the larger the existing accelerating high voltage is.

As described above, to adjust the coil current it is necessary to know the existing high voltage, since the deflecting current and the high voltage are functionally related according to a characteristic which is stored in the control unit 8. The high voltage itself is supplied at corresponding plugs 1 1, 12 at the housing side via corresponding cables 9, 10, and is transmitted to the cathode 4 or the anode dish 5 via corresponding cables 13, 14. As a rule, the high voltage is at both the cathode and anode sides, these respectively voltages usually equaling ±U/2 of the total high voltage. In order to be able to detect the respective sub-voltage, two voltage dividers 15, 16 are provided, these being connected between the respective high voltage—the respective cables 13, 14 in the example—and ground, at which the radiator housing 2 lies. Each voltage divider 15,16 has a serpentine resistor 18, 19 at which the corresponding positive or negative reference signal can be tapped. This reference signal represents a measure of the respectively existing sub-voltage, depending on the location of the tap. This signal is proportional to the existing voltage and should be in the range of a few volts. Reference signals $U_{ref-}$ and $U_{ref+}$ are transmitted to the control unit 8 via corresponding cables 20, 21. The control unit 8 adds the two reference signal values to form a total reference signal and, dependent on the stored characteristic, generates the control signal for the coil current.

Figure 2:
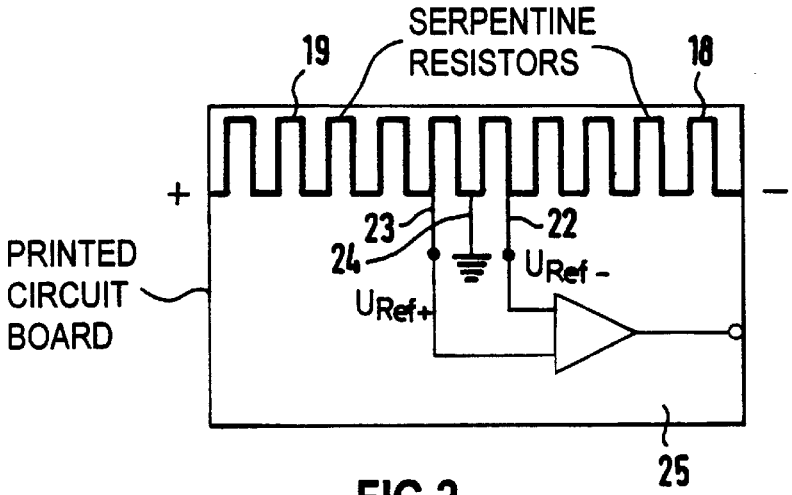
FIG. 2 is a schematic depiction of two voltage dividers suitable for use in the inventive X-ray radiator.

FIG. 2 shows the voltage divider circuit. The two serpentine resistors 18, 19 are illustrated, at which corresponding voltage taps 22, 23 and a ground terminal 24 are provided. Both voltage dividers, i.e., both serpentine resistors can be placed on a common printed circuit board 25. In the example illustrated in FIG. 2, the two reference signals $U_{ref+}$ and $U_{ref-}$ are emitted to the control unit 8 as a common signal.

In an X-ray radiator wherein the high voltage is at only the anode or at only the cathode, only one voltage divider is necessary. This also applies in the case where the total high voltage is supplied at the anode and at the cathode in parts, but these voltage portions have a predetermined relation to each other, or each voltage value essentially constantly equals ±U/2. In such a case also, it is necessary to tap only one reference signal, it being possible to then process this signal at the control unit 8 corresponding to the determination of the presently existing high voltage.

Although modifications and changes may be suggested by those skilled in the art, it is the intention of the inventors to embody within the patent warranted hereon all changes and modifications as reasonably and properly come within the scope of their contribution to the art.

We claim as our invention:

1. An X-ray radiator comprising:

a radiator housing;

a rotary X-ray tube rotationally mounted in said radiator housing, said X-ray tube including a cathode, which emits an electron beam, and an anode, on which said electron beam is incident for producing X-rays;

a magnet system disposed in said radiator housing which interacts with said electron beam to selectively deflect said electron beam from a straight line proceeding between said cathode and said anode, said magnet system including a coil in which a coil current flows;

an electrical tap for obtaining a reference signal corresponding to a high voltage existing between said cathode and said anode; and a control unit, supplied with said reference signal, for adjusting said coil current dependent on said reference signal.

2. An X-ray radiator as claimed in claim 1 wherein said tap comprises a tap which taps a reference signal which is proportional to said high voltage.

3. An X-ray radiator as claimed in claim 1 wherein said tap comprises a first tap for tapping an anode-side reference signal and a second tap for tapping a cathode-side reference signal, and wherein said control unit comprises a control unit for controlling said coil current dependent on a sum of said anode-side reference signal and said cathode-side reference signal.

4. An X-ray radiator as claimed in claim 1 wherein said high voltage comprises a voltage which is respectively across a cathode side and an anode side in a predetermined ratio, wherein said tap comprises a tap for tapping only one of said anode-side and said cathode-side, and wherein said control unit comprises a control unit for controlling said coil current dependent on said reference signal and said predetermined ratio.

5. An X-ray radiator as claimed in claim 1 wherein said reference signal is less than 40 V.

6. An X-ray radiator as claimed in claim 1 wherein said reference signal is less than 20 V.

7. An X-ray radiator as claimed in claim 1 wherein said reference signal is less than approximately 10 V.

8. An X-ray radiator as claimed in claim 1 wherein said control unit includes a memory in which a relationship between said coil current and said high voltage is stored, and wherein said control unit comprises a control unit for controlling said coil current dependent on said reference signal and said relationship.

9. An X-ray radiator as claimed in claim 1 wherein said tap includes a voltage divider connected between said high voltage and ground, said voltage divider having a voltage divider tap at which said reference signal is obtained and which is connected to said control unit.

10. An X-ray radiator as claimed in claim 9 wherein said voltage divider includes a serpentine resistance tapped at a selected location by said voltage divider tap.

11. An X-ray radiator as claimed in claim 1 wherein said tap comprises a first voltage divider connected between an anode side and ground and a second voltage divider connected between a cathode-side and ground, said first voltage divider having a first voltage divider tap at which a first component of said reference signal is obtained and said second voltage divider having a second voltage divider tap at which a second component of said reference signal is obtained, said first voltage divider tap and said second voltage divider tap being connected to said control unit.

12. An X-ray radiator as claimed in claim 11 wherein said first voltage divider comprises a first serpentine resistance, tapped at a selected location by said first voltage divider tap, and wherein said second voltage divider comprises a second serpentine resistance, tapped at a selected location by said second voltage divider tap.

13. An X-ray radiator as claimed in claim 1 wherein said control unit is disposed inside said radiator housing.

* * * * *